US005265363A

United States Patent [19]

Martin

[11] Patent Number: 5,265,363

[45] Date of Patent: Nov. 30, 1993

[54] MULTIFUNCTION MECHANICAL DISPLAY SYSTEM

[75] Inventor: Donald L. Martin, Hulmeville, Pa.

[73] Assignee: Say it All Systems, Inc., Croyden, Pa.

[21] Appl. No.: 879,406

[22] Filed: May 7, 1992

Related U.S. Application Data

[63] Continuation-in-part of Ser. No. 454,618, Dec. 21, 1989, abandoned.

[51] Int. Cl.[5] ..... G09F 7/00

[52] U.S. Cl. ..... 40/605; 40/622

[58] Field of Search ..... 40/152.1, 605, 606, 40/611, 617, 618, 620, 622; 248/297.3, 327

[56] References Cited

U.S. PATENT DOCUMENTS

| | | | |
|---|---|---|---|
| 959,896 | 5/1910 | Staren | 40/618 |
| 1,258,146 | 3/1918 | Russell | 40/618 |
| 1,414,536 | 5/1922 | Webster et al. | 40/618 X |
| 1,514,775 | 11/1924 | Litwin | 40/611 |
| 2,006,573 | 7/1935 | Isenhour | 40/611 |
| 2,054,698 | 9/1936 | Geistert et al. | 40/611 X |
| 2,561,813 | 7/1951 | Murphy | 40/618 |
| 2,632,271 | 3/1953 | Nigg | 40/618 |
| 3,079,714 | 3/1963 | Zeigler et al. | 40/618 |
| 3,828,457 | 8/1974 | Willis | 40/152.1 |
| 4,103,860 | 8/1978 | Haas et al. | 40/152.1 X |
| 4,717,110 | 1/1988 | Fohrman | 40/611 X |
| 4,888,894 | 12/1989 | Brown, Jr. | 40/606 |
| 4,977,696 | 12/1990 | Johansson | 40/605 |
| 4,977,698 | 12/1990 | Seggerson | 40/618 |
| 4,989,353 | 2/1991 | Aitolfi | 40/152.1 |

FOREIGN PATENT DOCUMENTS

| | | | |
|---|---|---|---|
| 2029996 | 3/1980 | United Kingdom | 40/605 |

*Primary Examiner*—Kenneth J. Dorner
*Assistant Examiner*—Brian K. Green
*Attorney, Agent, or Firm*—Panitch Schwarze Jacobs & Nadel

[57] ABSTRACT

A multifunctional mechanical display system comprises one or more signboards each having a substantially planar display area with a first bar member that preferably includes a plurality of posts which may be received in any of one or more parallel sets of openings through the signboard to position the first bar member at any of a plurality of parallel, spaced apart positions. Preferably, raised borders around the display area are parallel to the sets of openings and the first bar member and have, with the first bar member, facing sides which are adapted to receive and removably retain therebetween one or more planar, resiliently flexible inserts bearing preprinted indicia. Additional pins are further provided on the rear side of each signboard coinciding with one or more openings through the narrow sides of each signboard to permit the signboards to be joined together into larger signboards, to permit signboards to be mounted back-to-back, or both, through modular support members. The support members permit the provision of a variety of display configurations and display supports.

20 Claims, 5 Drawing Sheets

10
12
12'
14
16
18
20
22
24
26
28
30
32
34
36
37
38
40
44
44'
44"
45'
48
50
52
54
56
58
58'
58"
59
70
90
92
120
122
3
4

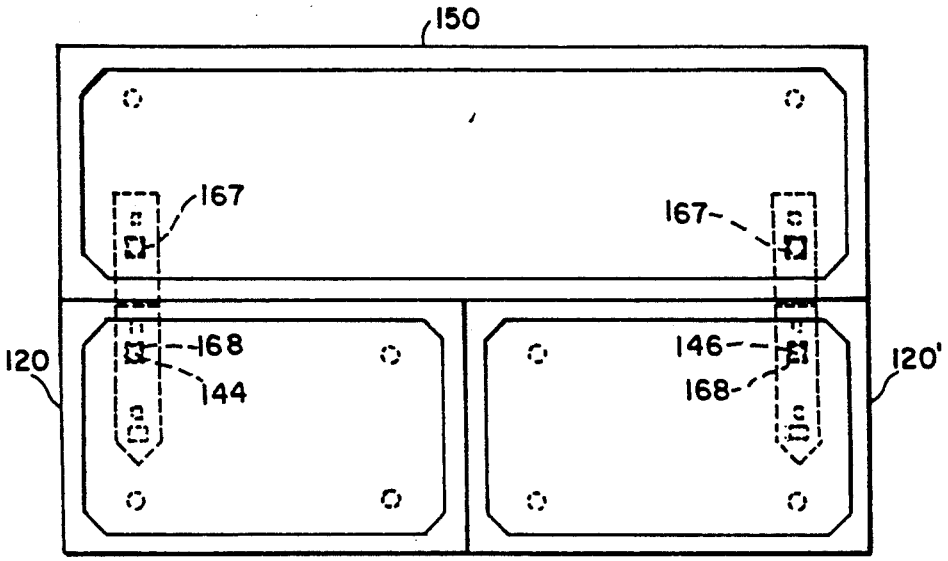
FIG. 15
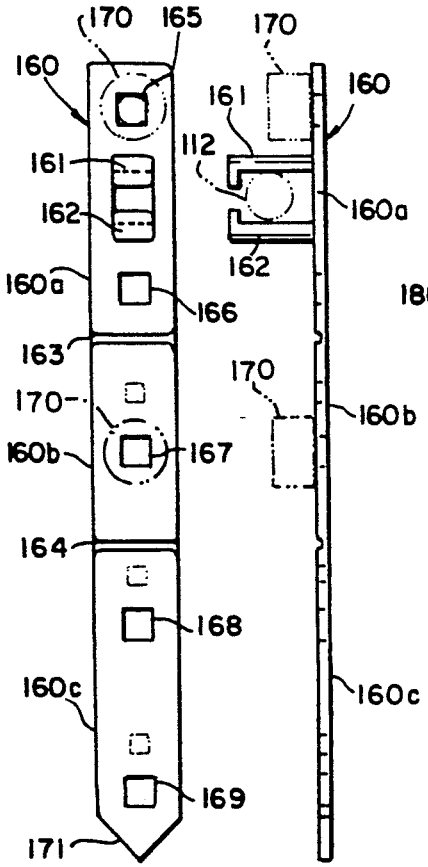
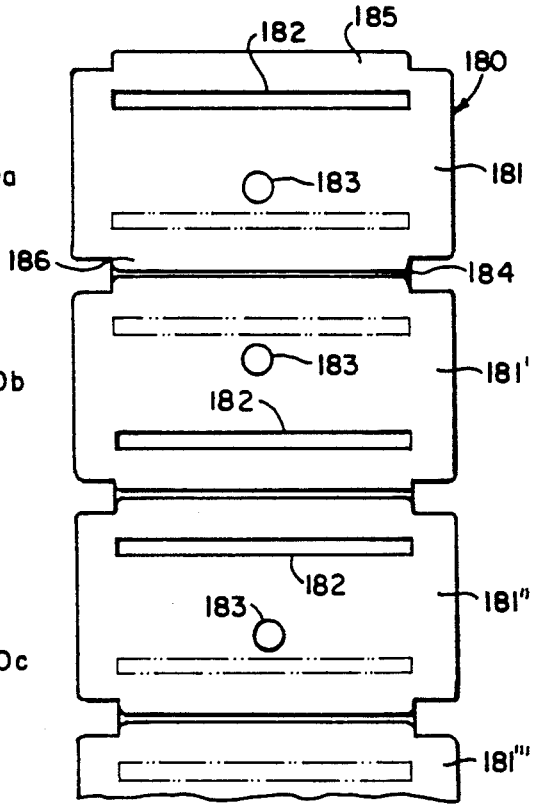
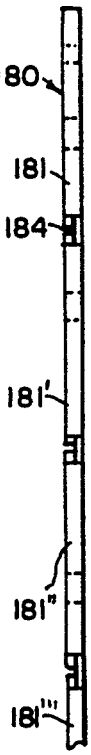
FIG. 16 FIG. 17 FIG. 18 FIG. 19

MULTIFUNCTION MECHANICAL DISPLAY SYSTEM

RELATED APPLICATION

This application is a continuation-in-part of application Ser. No. 07/454,618, filed Dec. 21, 1989, now abandoned.

FIELD OF THE INVENTION

The invention relates to display devices and, in particular, to a multifunction display system for point of sale use.

BACKGROUND OF THE INVENTION

Some point of sale displays which are used, for example, in produce sections, may be nothing more than a frame which may be provided with a backing on which information is written by the retailer or which can, by itself or with the frame, support one or more removable inserts carrying the information being displayed. In some designs dividers may be provided within the frame to break up the display area and the information being displayed within the frame. Such dividers typically permit the display of more information by permitting the mounting of several smaller inserts. In all such known devices, the dividers are fixedly secured with the frame thereby fixing the size and position of the data which can be presented or the inserts which can be used.

SUMMARY OF THE INVENTION

The present invention is a multifunctional mechanical display system which provides a user with versatility in building signboards of different size and selecting where information may be mounted and/or displayed on the signboard. In one of its basic forms, the multifunctional mechanical display system of the present invention comprises a first signboard having a pair of opposing major sides and at least one pair of generally parallel narrow sides on opposing ends of the signboard, one major side defining a substantially planar display area and each narrow side extending between the pair of opposing major sides. The display further comprises mounting means for removably mounting at least a first bar member to the signboard in the display area extending at least generally parallel to longitudinal directions of the pair of narrow sides. At least the one narrow side has at least a first opening therethrough and the system further comprises at least one mating means on a remaining one of the pair of major sides of the signboard. The one mating means is at least generally centered along a first axis extending through the first opening. The first axis is at least generally parallel to the plane of the display area and at least generally perpendicular to the longitudinal direction of the one narrow side.

In another basic form, the multifunctional mechanical display system of the present invention comprises a first signboard having a pair of opposing major sides and at least one pair of generally parallel narrow sides on opposing ends of the signboard, one major side defining a substantially planar display area and each narrow side extending between the pair of opposing major sides. The first signboard further includes at least one mating means on a remaining one of the pair of major sides for mating with a second element of the system. The system further comprises mounting means for removably mounting at least a first bar member to the first signboard in the display area extending at least generally parallel to longitudinal directions of the pair of narrow sides. The system further comprises a second signboard having a pair of opposing major sides and at least one pair of parallel narrow sides on opposing ends of the signboard, one of the pair of major sides defining a substantially planar display area and each of the pair of narrow sides extending between the pair of opposing major sides. The second signboard further includes at least one mating means on a remaining one of the major sides for coupling the second signboard with the first signboard. The system further comprises coupling means for coupling together at least one of the mating means of the first signboard with one of the mating means of the second sign with the display areas of the first and second signboards at least generally parallel.

BRIEF DESCRIPTION OF THE DRAWINGS

The foregoing summary as well as the following detailed description will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings:

FIG. 15 depicts two of the signboards of FIGS. 13 and 14 coupled side-by-side in a common plane with a third signboard of the present system approximately twice the size of each of the two smaller signboards;

FIG. 16 is a diagrammatic front elevation of a first modular support member of the present invention;

FIG. 17 is a diagrammatic side elevation of the member of FIG. 16;

FIG. 18 is a diagrammatic front elevation of a second modular support member of the present invention;

FIG. 19 is a side elevation view of FIG. 18;

DETAILED DESCRIPTION OF EMBODIMENTS

Figures 1, 2, 8, 12:
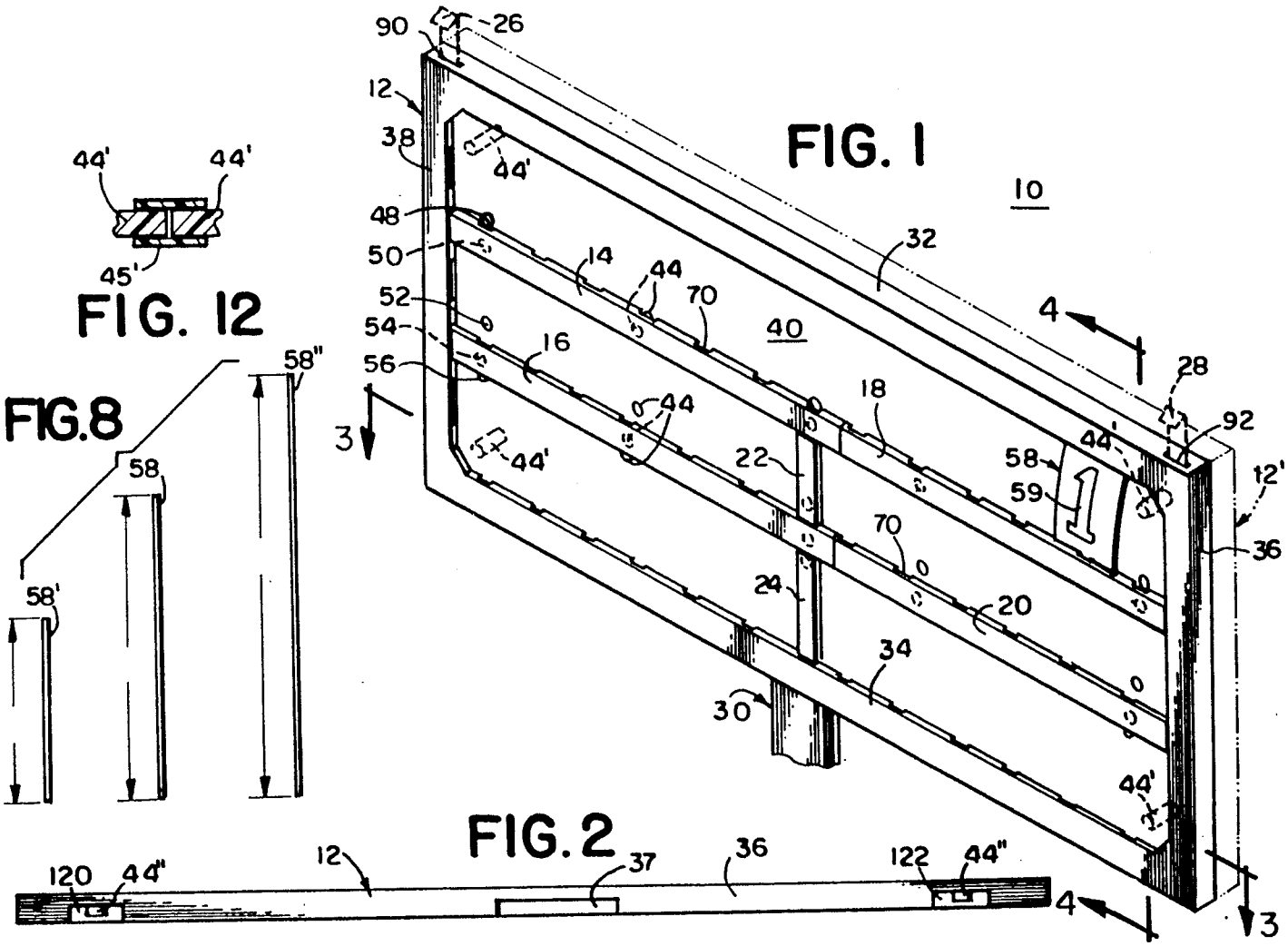
FIG. 1 is an isometric view of the multifunction display.
FIG. 2 is a bottom plan view of the signboard of the display of FIG. 1.
FIG. 8 is a side elevation of three inserts having different heights which can be used with the display.
FIG. 12 is a diagrammatic cross section showing the coupling of pins fixedly located on the rear side of each of a pair of back-to-back adjoining signboards.

In the various figures the same reference numerals are used to identify the same elements.

FIG. 1 depicts a preferred embodiment multifunction display system of the present invention, indicated generally at 10. Among the elements of the display system 10 depicted in FIG. 1 are a mechanical signboard 12 and a plurality of bar members 14, 16, 18, 20, 22 and 24, each preferably elongated. The bar members include identical first and second large, elongated, horizontal divider bars 14 and 16, respectively, identical first and second small, elongated, horizontal divider bars 18 and 20, respectively, and identical elongated vertical divider bars 22 and 24, respectively. These may be referred to collectively as elongated bar members or specifically with respect to their function as horizontal or vertical divider bars in this preferred embodiment. The display 10 also comprises identical, optional, removable hangers 26 and 28 (indicated in phantom) and an optional, removable upright support member 30.

The signboard 12 also preferably includes first and second horizontal borders 32 and 34 and third and fourth vertical borders 36 and 38, which preferably surround, enclose and define sides of a display area, indicated generally at 40, in which the various elongated bar members are located. In the depicted embodiment 10, the display area 40 is preferably planar and centrally located on the signboard 12. The borders 32, 34, 36 and 38 are raised with respect to the central area 40. However, the central area 40 may be depressed with respect to the borders 32, 34, 36 and 38 or other configurations used for delimiting borders from a display area. The various elongated bar members depicted are sized sufficiently small to fit within the display area 40 defined by the four encircling borders 32, 34, 36 and 38.

Figures 3, 4, 5, 6, 7, 9, 10, 11:
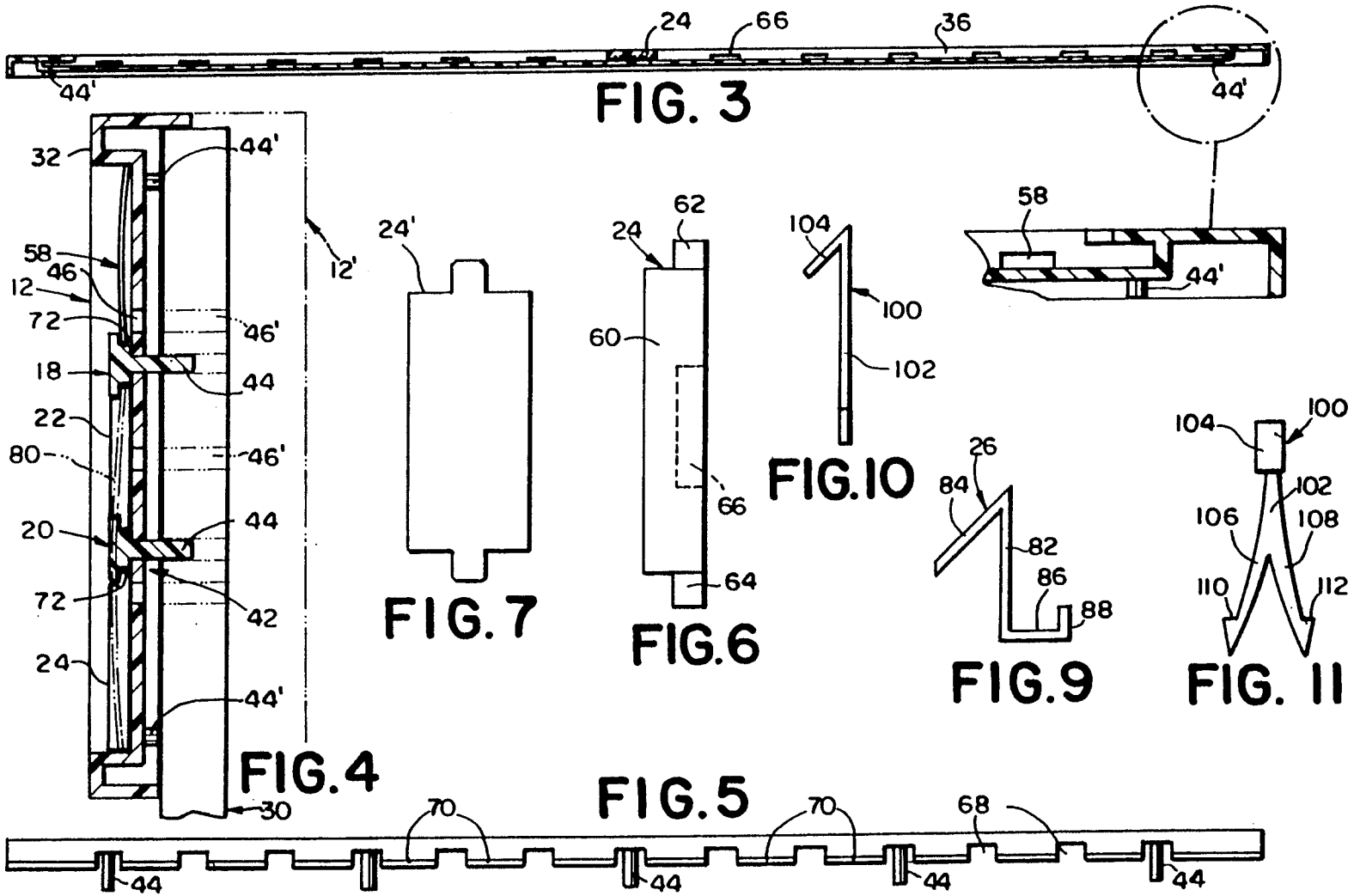
FIG. 3 is a longitudinal section view taken along lines 3—3 of FIG. 1.
FIG. 4 is a vertical section taken along the lines 4—4 of FIG. 1.
FIG. 5 is a plan view of a pair of adjoining, horizontal divider bars for use in the display of FIG. 1.
FIG. 6 is a side elevation of a vertical divider bar.
FIG. 7 is a front elevation of another vertical divider bar for use in the display.
FIG. 9 is a side elevation of a first embodiment hanger.
FIG. 10 is a side elevation of a second embodiment hanger.
FIG. 11 is a front elevation of the hanger of FIG. 10.

An important aspect of the invention is the provision of mounting means, indicated generally at 42 in FIG. 4, for removably mounting the horizontal bar members 18 and 20 to the signboard 12 in the central area 40 at any of a plurality of locations. Identical means are provided for removably mounting bars 14 and 16 in the central area 40. Preferably, the mounting means 42 comprises first mating means preferably provided by a plurality of posts 44 on each of the horizontal divider bars 14, 16, 18 and 20, two of the posts 44 being depicted in FIG. 4. The mounting means 42 further comprise second mating means on the signboard 12 preferably provided at fixed, predetermined locations for presizing the inserts 58 which may be used. Preferably, the second mating means are provided in the form of plural sets of openings 46 extending through the central area 40 complementing the first mating means posts 44. Preferably, the posts 44 and openings 46 are sized and configured in cross section so that the posts 44 frictionally engage with the signboard when they are received sufficiently in the openings 46 and permit removable coupling of each of the horizontal divider bars 14, 16, 18 and 20 with the signboard 12.

Referring back to FIG. 1, at least two and preferably at least four separate sets of the second mating means openings 46 are provided through the signboard 12 in the form of rows. Five rows of openings 46 are indicated generally along only the left side of the board 12 in FIG. 1 at 48, 50, 52, 54 and 56. All rows but row 52 are fully or partially hidden behind the horizontal divider bars 14, 16, 18 and 20 in FIG. 1. Each of the rows 48, 50, 52, 54 and 56 extend in parallel to one another and to the first and second (upper and lower) borders 32 and 34, respectively. Preferably too, the posts 44 and openings 46 in each row are uniformly spaced from one another with the same horizontal spacing being maintained for all of the rows 48, 50, 52, 54 and 56.

The rows 48, 50, 52, 54 and 56 have a preferred vertical spacing. Row 48 is spaced approximately three times as far from the bottom border 34 as it is from the top border 32 for dividing off the top quarter portion of the central area 40 from the remaining three-quarters of that area. The row 50 is spaced approximately twice as far from the bottom border 34 as from the top border 32 to separate the top third of the central area 40 from the remaining two-thirds. Row 52 is spaced midway between the first and second borders 32 and 34 for dividing central area 40 into two equal halves. Row 54 is spaced approximately twice as far from the top border 32 as from the bottom border 34 to divide off the bottom third of the central area. Row 56, if provided, is spaced approximately three times as far from the upper border 32 as from the bottom border 34 to segregate the bottom quarter of the central area 40 from the remainder. Thus, one of ordinary skill will appreciate that the various rows 48, 50, 52, 54 and 56 of openings 46 provide the user with a great deal of flexibility in removably mounting horizontal divider bar(s) 14, 16, 18 or 20 at different positions in the display area 40, spaced at different distances from one another and the first and second borders 32 and 34, for dividing the display area 40 into smaller rectangular areas of various sizes so that inserts of different heights may be removably retained depending upon the position(s) of divider bar(s) 14, 16, 18, 20, 22 and/or 24 in the display area 40. Moreover, since any of the long or short horizontal bar members can be omitted or located in a row of holes other than the rows receiving any of other type or horizontal bar member even greater arrangements and divisions on the display area 40 are possible, such as thirds on one side and halves on another or halves on one side and a full height area (no horizontal bar) on another, etc. As used in this application when referring to inserts, height refers to the dimension of the insert between the divider bar(s) and/or border(s) between which the insert is removably retained.

FIG. 3 depicts, in part, the mounting of lower vertical divider bar 24 which is shown in an expanded view in side elevation in FIG. 6. The divider bar 24 preferably includes a central rectangular body portion 60 and a pair of opposite ear portions 62 and 64, respectively, projecting from opposing sides of the body portion 60. The lower ear 64 is received in one of a plurality of uniformly sized and spaced openings 66, best seen in FIG. 3, which preferably are formed by undercuts molded into the side of the lower border 34 facing the horizontal divider bars 14, 16, 18 and 20 and display area 40. An identical set of openings (not depicted) preferably are symmetrically provided by undercuts molded into the lower side of the upper border 32 facing the horizontal divider bars 14, 16, 18 and 20 and display area 40 to receive an ear 62 or 64 and removably retain each divider bar 22, 24 oriented perpendicularly to horizontal bars 14, 16, 18 and 20. Identical sets of uniformly sized and spaced openings 68 are preferably provided extending in a perpendicular direction to the elongated dimension of each of the horizontal divider bars 14, 16, 18 and 20, along opposing narrow longitudinal sides of those bars facing the upper and lower borders 32, 36 and one another (upper and lower longitudinal sides of the bars in the various figures), also for receipt of ear portions 62 and/or 64 of vertical divider bars 22 and 24 or other, comparable divider bars, such as 24' in FIG. 7. As is further indicated in FIG. 6, vertical divider bar 24 may also be provided with a recess or cavity 61, indicated in phantom, extending into the divider bar 24 from its rear outer surface, to permit the divider bar to be flexed sufficiently for insertion of the ear portions 62 and 64 in the appropriate openings 66 and/or 68.

FIG. 7 depicts a slightly smaller vertical divider bar 24' which might be used, for example, between horizontal bars 14 and 18 and the upper border 32 when the horizontal bars are received in row 48 of openings 46 and/or between pairs of bars 14 and 18 or 16 and 20 when either of those pairs of bars are received in the openings of rows 48 and 52, or 52 and 56. A third vertical divider bar, which might be provided for extending between one of the horizontal divider bars 14, 16, 18 or 20 and either the upper border 32 or bottom border 34 when the horizontal divider bar is positioned along the central row 52 of opening 46 is not depicted but would be substantially identical, except for height, to the divider bars 24 and 24' in FIGS. 6 and 7.

FIGS. 4 and 5 also reveal the manner in which planar inserts, such as planar insert 58 in FIG. 1, are mounted between facing sides of horizontal divider bar 18 and upper border 32. Referring to FIG. 5, each of the horizontal divider bars 14, 16, 18 and 20 is preferably provided with a notch or step 70 extending along each upper and lower narrow longitudinal side, at the rear edge of the side, most proximal the posts 44. When a divider bar 14, 16, 18 or 20 is mounted to the signboard 12, the notches 70 form, with the planar surface of the display area 40, a recess or channel 72, seen in FIG. 4, which runs along each facing (upper and lower) side of each horizontal divider bar 14, 16, 18 and 20 to removably receive an end of an insert 58. The insert 58 is mounted on the signboard 12 as indicated in FIG. 4 by flexing the insert 58, inserting one end of the flexed insert 58 into the channel 72 formed by member 18 and area 40, where it is received and removably retained, and releasing the insert 58, allowing it to flex back to a near planar condition and against the facing (lower) side of upper border 32. Preferably, the transverse dimension of the channel 72, normal to the planar surface of display area 40 is only about 0.001 inch greater than the thickness of the insert 58 received. Preferably too, the inserts 58 are sized in height slightly larger than the space provided between the facing horizontal divider bar(s) and/or an upper or lower border so that the inserts remain slightly flexed and compressed in height when mounted to help retain them. Resiliency of the inserts thus assists in keeping them in place. If desired, similar channels can be provided along the facing (lower) surface of the upper border 32 and the facing (upper) surface of the lower border 34, but these have not been found to be necessary. Also, grooves 70 and the resulting channels 72 might be eliminated and the insert(s) merely removably retained between the facing sides of the divider bar(s) and/or the border(s) without actually being received in either facing side, but such a configuration is not preferred. Also, instead of a step 70, the facing side(s) of the divider bar(s) and/or border(s) can be shaped in other ways for retaining an insert such as the facing side being shaped to form an included angle of no more than about and, preferably, less than 90° with respect to the planar central area 40. Thus, either of the upper and lower borders 32 and 34 and any second horizontal bar member can be used as a retaining means with respect to a first horizontal bar member, spaced from any of the possible different spaced apart positions at which the first bar member may be mounted on the signboard 12 in the display area 40. Each retaining means thus has a side facing a facing side of the first bar member and is adapted to at least removably retain therebetween (i.e., between the facing sides) one of the resiliently flexible planar inserts for removably retaining therebetween any of the inserts of different heights (for example, 58, 58' and 58" in FIG. 8), depending upon the location of the first bar member at any of the plurality of spaced apart positions it may occupy in any of the rows 48, 50, 52, 54 and 56 in the display area 40.

FIG. 8 depicts diagrammatically and only approximately in relative scale, three preferred relative heights of three sets of inserts which preferably would be preprinted with indicia 59 (see FIG. 1) on at least one of its two opposing major planar sides and used with the signboard 12 and divider bars 14, 16, 18, 20, 22, 24 and/or 24'. The indicia 59 may be individual alphanumeric or punctuation symbols, words, phrases, titles, graphics or other visual designs. Preferably, the heights of the three sets would be selected such that the inserts 58' of one set would extend approximately one-quarter of the height of the central display area 40, the inserts 58 of the second set would extend approximately one-third of the height of the central display area 40 and the inserts 58" of the third set would extend approximately one-half of the height of the central display area 40. Insert 58', for example, would be used in any of the one-quarter height areas of the signboard formed, for example, between the horizontal divider bar(s) in top row 48 and the upper border 32, between the divider bar(s) in bottom optional row 56 and the bottom border 34 and between the divider bar(s) in the first and third rows 48 and 52 or third and fifth rows 52 and 56, respectively. Larger inserts 58 would be used in any of the three, one-third equal height areas formed by the divider bars in the configuration shown in FIGS. 1 and 4. Larger inserts 58' would be used in either of the one-half height areas between any horizontal divider bar(s) in middle row 52 and either the upper or lower border 32 or 34, respectively. Accordingly, a preferred aspect of the invention is a kit comprising signboard 12, or its equivalent, a plurality of horizontal divider bars and at least two and preferably three sets of preprinted, flexible, planar inserts having different relative heights. Though not presently intended, even larger inserts can be provided for spanning areas of the signboard which are greater than half the height of the central area. For example, FIG. 4 depicts in phantom an insert 80 spanning the portion of the central area extending between the facing sides of horizontal divider bar 18 in row 50 and the lower border 34, and covering approximately two-thirds of the height of the central area 40. Similarly, inserts (not depicted)

could be provided covering up to approximately three-quarters of the height of the central area 40 for extending between the horizontal divider bar(s) mounted in the upper row 48 and the bottom border 34 or between horizontal divider bar(s) mounted in the lowermost, optional row 56 and the upper border 32 and even larger inserts for covering the full height of the central area 40.

FIG. 9 depicts in greater detail the side profile configuration of a preferred hanger 26. Hanger 28 is identical. The hanger 26 includes central body portion 82, a hook 84 provided at one end of the central body portion and a land 86 provided at an opposing end of the central body portion. A second smaller hook 88 is preferably provided at a remaining end of the land 86. The smaller hook 88 and land 86 are inserted into either of the closed circumference openings or slots 90 or 92 provided along the upper narrow sides of the signboard 12.

FIGS. 10 and 11 depict the configuration of an alternate hanger 100 having a central body portion 102, a hook 104 formed at one end of the body portion 102 and a pair of resiliently flexible legs 106 and 108 formed at an end of the body portion 102 opposite the hook 104. Each of the legs 106 and 108 is provided with a land 110 and 112, respectively, which interferingly engages with portions of the signboard 12 adjoining either of the closed circumference slots 90 and 92 receiving the hanger 100.

Referring to FIGS. 1 and 3, there is preferably provided on the "back side" of the signboard 12 projecting transversely from the plane of the central area 40 plural integrally molded posts 44', preferably one at each of the four corners of the signboard 12. These posts 44' permit back-to-back mounting of identical signs 12 and 12' as shown in FIG. 1, in a manner depicted in FIG. 12, by the use of suitable means such as a resilient tubular plastic grommet 45' receiving ends of the adjoining posts 44' and 44' of the back-to-back signboards like signboard 12 and phantom signboard 12' in FIG. 1.

A single signboard 12 or a pair of back-to-back positioned signboards 12 and 12', like that shown in FIG. 1, can be similarly supported through the upright support 30. Referring to FIG. 4, the upright support 30 is provided with five openings 46' (in phantom), located so as to receive first mating means 44 extending through the central openings of each of the rows 48, 50, 52, 54 and 56 (see FIG. 1) to thereby removably affix the signboard 12 with one or more of the horizontal bar members 14 and 16. The opening 46' in the support member 30 act like the aforesaid grommets 45' (FIG. 12) in receiving ends of the adjoining mating means posts 44 and 44 of the back-to-back signboards 12 and 12', respectively. A cutout 37 is provided through the bottom side edge of the signboard 12 (FIG. 2) for receiving the support member 30.

Although the preferred signboard 12 has four raised borders 32, 34, 36 and 38 surrounding the planar central display area 40, one of ordinary skill will appreciate that at least either opposing pair of borders 32 and 34 or 36 and 38 need not be raised or provided and that flexible inserts may be mounted to the board between divider bars or between divider bars and the opposing pairs of borders 32 and 34 or 36 and 38 through the resulting open sides, if provided. One of ordinary skill will also appreciate that the borders might be eliminated entirely and removable divider members used exclusively for removably retaining inserts of various sizes to a signboard at various locations.

Furthermore, if desired, narrow channels could also be provided along the facing sides of the upper and lower borders 32 and 34 so that inserts may be retained entirely by interference fit between the sides of such channels and the channels 72 formed by the horizontal divider bars 14–20 and the central area 40 of the signboard 12. Furthermore, one-piece horizontal divider bars 14/18, 16/20 can be provided extending the entire width of the central display area 40 between the side borders 36 and 38, if desired. However, the large and small horizontal divider bars disclosed are preferred because at least one of the two types of bars can be made symmetric for use with another signboard (not depicted) having a smaller width. Also, very short bars or equivalent members can be provided spaced apart horizontally to provide point reception and retention along opposing sides of each insert.

For example, suggested dimensions for the signboard 12 are about fourteen-and-one-half inches in width and about six inches or more in height with the borders being about one-half inch in width yielding a planar central display area approximately thirteen-and-one-half inches wide and five inches high. Preferably, the divider bars are approximately one-half inch wide or less. Preferably, the large horizontal divider bars 14 and 16 are approximately seven-and-five-eighths inches long so as to span a smaller signboard of substantially the same construction as signboard 12 but having a central area, for example, of only about seven-and-five-eighths inches width. The depth of the notch or step 70 and resulting channel 72 need only be about one-sixty-fourth of an inch in depth.

The signboard is preferably of a one-piece construction and injection molded of a medium-impact plastic, for example styrene, in a thickness of at least about 50 mils and, preferably, about one-sixteenth inch thick for strength and appearance and to provide openings 68 on the upper and lower borders 32 and 34, which could not be provided with a vacuum formed signboard without further processing after forming. Divider bars 14, 16, 18, 20, 22 and 24 are preferably injected molded from styrene and are about one-quarter inch thick.

Preferably, the inserts 58, 58', 58'', etc. are formed of a flexible, planar plastic material which can be printed upon with conventional printing equipment such as letter presses or flexographic presses. Presently preferred is a laminate sheet plastic material sold under the name, "Transvy", by Transilwrap Co. of Chicago, Ill., in a thickness of about fifteen mils. It is presently believed that inserts of this material should be at least about ten mils thick to provide sufficient rigidity as well as resiliency.

The present invention provides users with considerable versatility in creating customized displays. Inserts 58 of the type previously described are quickly and easily fabricated and printed at relatively modest cost. Because of the structural strength provided to the signboard 12 by the raised borders 32, 34, 36 and 38 and the monolithic construction provided by the injected molding process, the inserts need not be as rigid and self supporting as inserts previously used. The preferred signboard 12 readily accommodates inserts varying, for example, between about one to five inches in height and bearing printed indicia ranging from about three-quarters inch to nearly five inches in height, while permitting the user considerable freedom in arranging displays. This includes simultaneously displaying letters of different heights in a variety of locations on the board.

Cutouts 120 and 122 can also be provided at either end of the bottom side of the signboard 12 (see FIG. 2) to provide access to the lower pins 44' and permit each signboard 12 to chain hang another signboard (not depicted) using removable fasteners (not depicted) between an opening 120/122 and an adjoining opening 90/92 on the hung sign.

Figure 13:
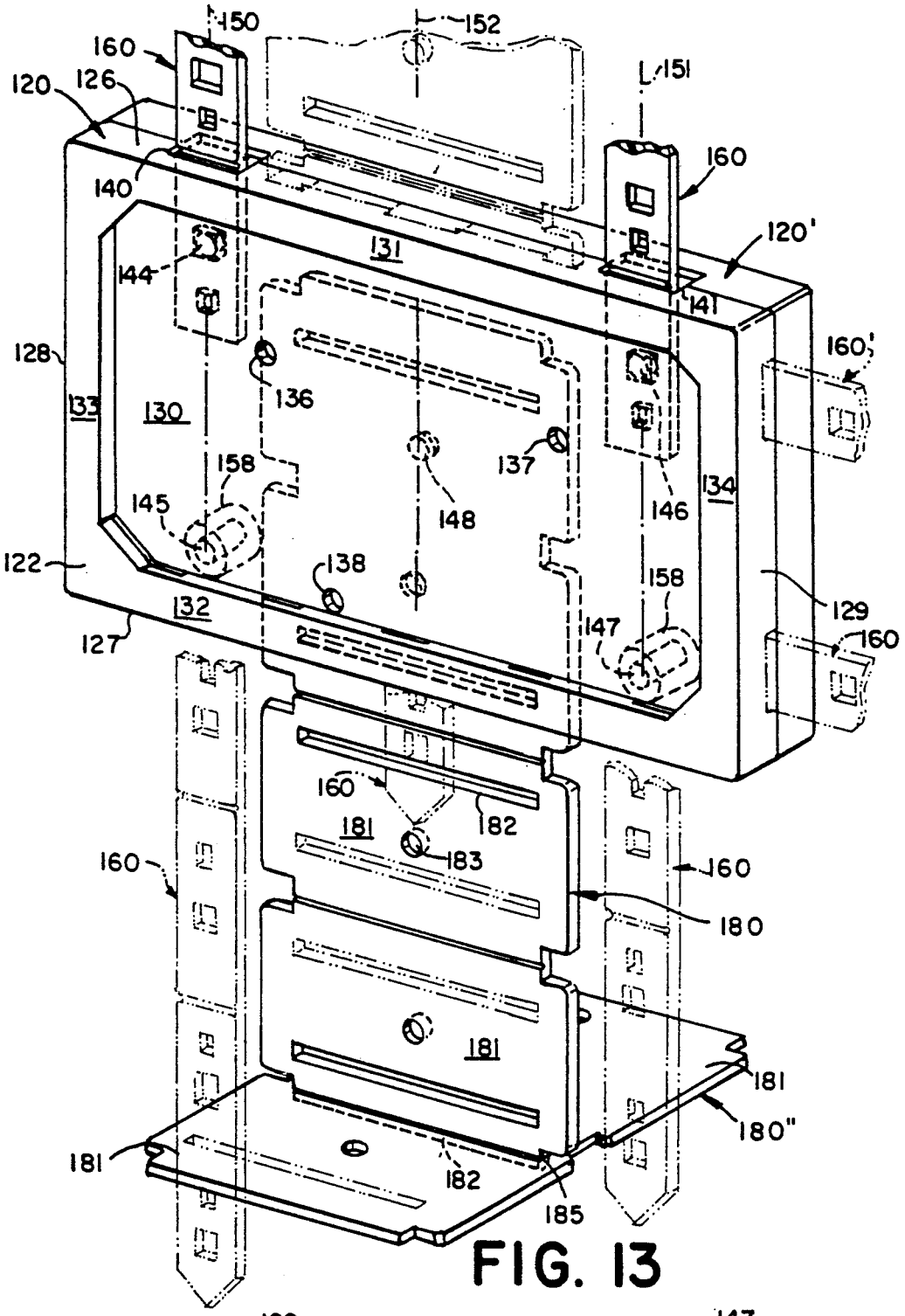
FIG. 13 is a diagrammatic perspective showing a pair of signboards of the present system joined with one another and supported in varying ways.

FIG. 13 depicts first and second identical signboards of the present invention, which are indicated generally at 120 and 120' and are mated together back-to-back in a display. Each signboard 120, 120' has a pair of opposing major sides, which are indicated generally at 122 and 124 in FIG. 14 with respect to signboard 120. Signboard 120 further includes a first pair of longer, narrow sides 126, 127 on its opposing upper and lower ends, which extend between the major sides generally parallel to one another and perpendicular to the overall plane of the signboard 120. A pair of shorter, narrow sides 128, 129 connect the longer narrow sides 126, 127 and the major sides 120, 122 and extend generally perpendicularly to those longer narrow sides and the planes of the major sides and of a central planar display area 130 on a first major side 122. First and second circular openings 136, 137 are provided through the major sides 122, 123 in the display area 130 for removably mounting a first bar member like one of the bar members 14, 16, 18, 20 of the first embodiment. The bar member would be sized to fit between the shorter, narrow sides 128, 129 of the signboard 120 and extend in parallel to the longitudinal directions of the longer sides 126, 127, which are horizontal in the figures. Preferably, the openings 136, 137 are equally spaced from the nearer (proximal) short sides 128, 129, respectively, so that each opening 136, 137 in the first signboard 120 aligns with a similar opening in second signboard 120'. The openings 136, 137 constitute half of the mounting means for removably mounting a first bar member to the signboard 120 in display area 130, the second part being the post of the first bar member. The bar and its post are omitted from these figures for clarity. A third opening 138 is provided to receive a colored pin representing a decimal point, if desired.

The central planar display area 130 is defined by raised upper and lower borders 131, 132 and raised opposing side borders 133, 134. Each of the upper and lower borders 131, 132 constitutes a retainer means on the signboard spaced from the first bar member, when it is installed in the openings 136, 137. Again, the borders 131–134 and first bar member would be configured like those of the first embodiment shown in FIGS. 1–5 to removably receive and retain a planar insert in the display area 130.

Figure 14:
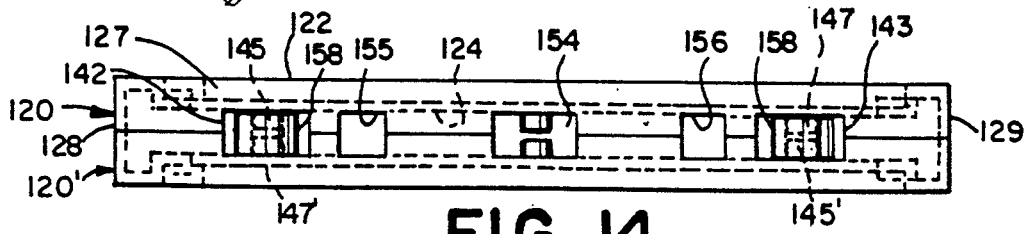
FIG. 14 is a bottom plan view of a pair of joined signboards omitting all lower supports.

As seen in FIG. 13, upper narrow side 126 preferably has first and second openings 140, 141 therethrough. The openings 140, 141 are spaced from one another and are located generally proximal longitudinal ends of the one narrow side 126. As best seen in FIG. 14, the lower narrow side 127 has a mirror image set of openings 142, 143 therethrough. The first opening 140 of the upper narrow side 126 and first opening 142 of the lower narrow side 127 are each centered on a first axis 150. Axis 150 extends through each opening 140, 142, generally parallel to the plane of the central display area 130, perpendicular to the longitudinal (horizontal) directions of the narrow upper and lower sides 126, 127, and parallel to the longitudinal (vertical) directions of the shorter narrow sides 128, 129. Openings 141 and 143 are similarly centered with respect to a second axis 151 generally parallel to and laterally spaced from the first axis 150. Also centered along the first axis 150, projecting from the remaining major side 124 of the signboard 120, are pins 144 and 145. Pins 146 and 147 similarly project from the remaining major side 124 and are similarly centered with respect to the second axis 151. A fifth pin 148 projects from the center of the remaining side 124, midway between the vertical narrow sides 128, 129 and the horizontal narrow sides 126, 127. Each of the pins 144–148 constitutes a mating means accessible from the remaining major side 124 of signboard 120, directly opposite the display area 130, for coupling another element of the system to the remaining side of the signboard 120. Also, each mounting pin of each bar member mounted to the display area and projecting through openings 136, 137 and the remaining side 124 of the signboard constitutes a mating means accessible from that remaining side.

Referring to FIG. 14, the lower narrow side 127 of the signboard is further preferably provided with three additional openings therethrough indicated at 154, 155 and 156. Opening 154 and pin 148 are each centered midway between vertical sides 128, 129. Openings 155 and 156 are symmetrically provided on either side of opening 154.

Numerous other elements of the system are shown coupled to the pins 144–148 in FIG. 13 and in FIGS. 14, 15 and 20–25. In particular, pins 145 and 147 are coupled with mirror image pins 147' and 145' of signboard 120' through lengths of tubing 158. The tubing 158 is of sufficient length and size to receive and frictionally engage each pair of facing pins. Tubing lengths 158 join the remaining major sides of the two signboards 120, 120' together in orientation by coupling together those pairs of pins 145, 147' and 147, 145'. In the same way, pins 144, 146, pins 148, and bar member pins through openings 136, 137 can be coupled together with mirror image pins on a second signboard 120'. At least one, and preferably at least two of the tube lengths 158, are provided to securely join signboards 120, 120' together.

Also indicated in FIG. 13 in both solid and phantom depiction are portions of first embodiment modular support members 160 and portions of second embodiment modular support members 180.

A modular support member 160 is shown in greater detail in FIGS. 16 and 17. Support member 160 is generally planar except for a pair of hook-shaped projections 161 and 162 which extend from one major planar side of the member and turn to face one another. The projections are provided with a space therebetween to receive and engage a horizontally oriented, preferably cylindrical support indicated in phantom at 112 in FIG. 17. Member 160 is further preferably provided with a pair of parallel spaced grooves 163, 164, where the material forming the support member is thinned, to permit the support member 160 to be broken into upper, middle and lower segments **160*a*, 160*b*, 160*c*, or adjoining pairs of those segments. The support member 160 is further provided with a series of five spaced openings therethrough 165–169. Openings 165–169 are sized to receive and frictionally engage pins 144–148 of signboard 120 and similar signboards and positioned to engage adjoining pins on signboards of the system. Additional openings can be provided as is indicated in phantom, if desired. Also, one or more tubular projections like projection 170, which can be used to couple together back-to-back adjoining signboards, may be provided. Finally, a pointed end 171** is also provided.

As will be described subsequently with respect to many of the remaining figures, the support members 160 may be used in a variety of ways to support signboard(s) 120, 120' and similar signboards, from their tops or bottoms, with their display areas at least generally vertically oriented and parallel. Members 160 can be used further for coupling together the pins or other suitable mating means of signboards 120, 120', etc. which are positioned in a common plane with narrow side abutting narrow side, for example as shown in FIGS. 15 and 20–25.

Figure 24:
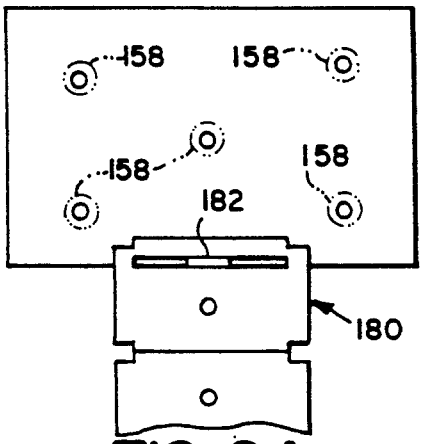

FIG. 13 further depicts portions of a second embodiment modular support member of the system of the present invention, each of the portions being indicated generally at 180' and 180'' in the figure. Referring to FIGS. 18 and 19, the second embodiment support member 180 is preferably formed by a plurality of integrally joined, identical elements 181, 181', etc. Each element 181, 181', etc. is generally rectangular with small rectangular cutouts at each of its corners, at least one narrow rectangular opening 182 therethrough, extending across the major dimension of the element, proximal to one of the two longer sides of the element. A single circular opening 183 is provided through the element, preferably but not necessarily closer to a remaining longer side of the element. Preferably, the elements 181, 181', etc. are molded in continuous chains as indicated in FIGS. 18 and 19, each element 181 in the chain being reversed in orientation from its adjoining element(s). Adjoining elements are delineated from one another by transverse grooves 184. The grooves permit the elements to be separated from one another. The cutouts at the corners of each element 181 define mirror image tabs 185, 186 on each of the opposing longer sides of each element 181. Each tab 185, 186 is sized to be received in and to frictionally engage with slot 182 also provided in each element 181. Slot 182 of each element 181 is further configured to receive and frictionally engage with the two portions of the lower narrow side 127 of the signboard 120 which are defined between the openings 155 and 156 as is best seen in FIG. 24.

Figure 23:
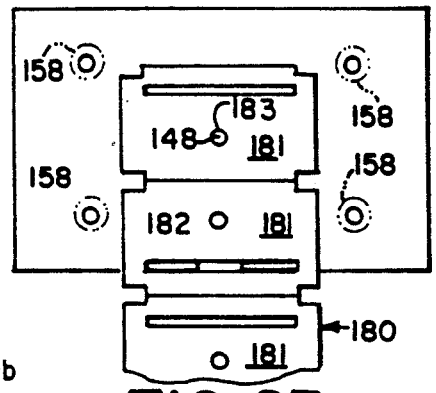
FIGS. 23–24 depict two possible configurations for the mounting of the second modular embodiment support member(s) of FIGS. 18 and 19 with one of the signboards of the present invention.

In the configuration of the system shown in FIG. 13 and FIG. 23, the circular opening 183 of the top element 181 mates with the central pin 148 of the signboard 120 while slot 182 of the second element 181' mates with lower narrow side 127 of signboard 120 to provide double engagement if greater coupling is desired between support member 180 and the signboard 120.

In addition to the preferred configurations provided by the described preferred support members 160, 180 through the various previously described openings in the top and bottom narrow sides of the signboards 120, 150, etc., additional openings can be provided, if desired. One suggested opening would be through the upper side wall 126, mirroring opening 154 through lower side wall 127. Openings mirroring all three openings 154–156 through side wall 127 can be provided through upper side wall 126 to permit either type of support 160, 180 to be extended through the top center of side 126. Similar openings can be provided in the opposing narrow sides 128, 129 centered along axes connecting upper pins 144–146 and/or 145–147, as is indicated in phantom on side 129 of FIG. 13, to permit the attachment of support member(s) 160 for side to side mating of the signboards.

Individual signboards of the present invention can be combined in myriad ways to make composite displays which are two sided, much larger than the largest individual signboard of the system and/or of varying shapes. For example, FIG. 15 depicts an exemplary coplanar (side-by-side) mating of signboards 120, 120' with a larger signboard 150, preferably at least twice the width of each of the smaller boards 120, 120' to form a coplanar display larger than the largest individual board employed. Each signboard 120, 120' is joined to the longer narrow bottom side of board 150 by pairs of attached support member segments **160*b*, 160*c* which extend through aligned openings in the adjoining, preferably abutted narrow upper sides of lower boards 120, 120' and the lower narrow side of board 150. Openings 167 and 168 of each member 160 are engaged with pins 144 and 146, respectively, and a lower pair of pins on board 150**. In this way, elements of the present invention provide a truly modular system which can be configured in a variety of ways to allow the ultimate user to essentially customize each display for any of a variety of uses.

Referring now to FIGS. 20–25, there is shown some of the various possible configurations for applying support members 160 or portions thereof or support elements 181 of support member(s) 180 to support signboards of the present invention or to simultaneously link and support them as a single assembly. All FIGS. 20–25 are from the rear (remaining major side) of the board(s).

Figure 20:
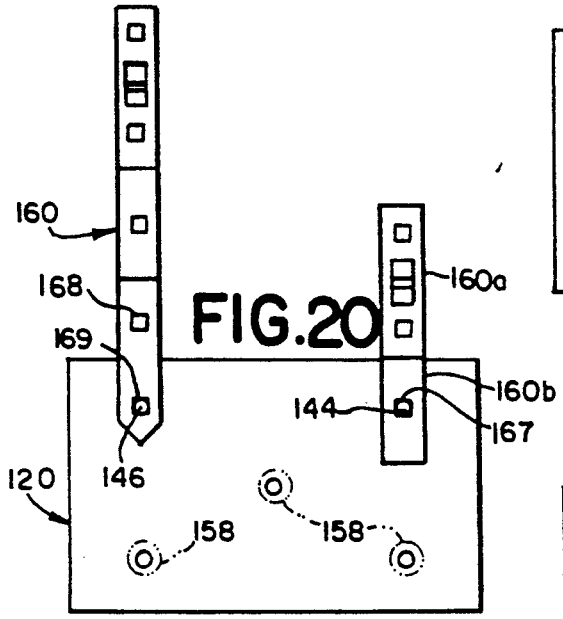
FIGS. 20 through 22 depict diagrammatically various possible mountings of the first modular support member of FIGS. 16 and 17 to one of the signboards of the present invention.
Figure 21:
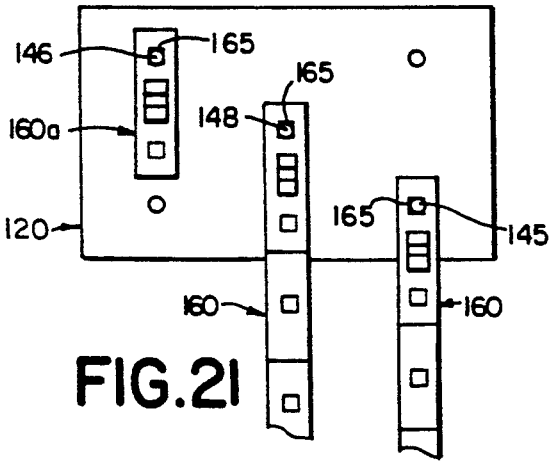

FIGS. 20–21 chart the progression of a support member 160 attached to a typical signboard 120 in a way which retains the hook-shaped projections 161, 162 of the top segment. On the left side of FIG. 20, bottom opening 169 is applied to pin 146 of signboard 120. In addition, lower segment opening 168 can be applied to the same pin 146 simply by lowering member 160 along the left side. When engaging opening 167 in the middle segment with pin 144, as shown on the right side of FIG. 20, the lower segment is preferably removed at slot 164 if neither of the lower openings 169, 168 align with lower pin 147. Though not shown in any of the figures, opening 166 can be applied to pin 144 (or 146) by simply lowering the segment shown in the right side of FIG. 20 a sufficient amount to engage those two elements.

If uppermost opening 165 of the top segment of element 160 is mounted to one of the top two pins 144, 146, preferably the intermediate and lower segment **160*b*, 160*c* are removed along slot 163 as shown on the left-hand side of FIG. 21. Either opening 165 or 166 can be mated with center pin 148, without any modification to the member 160. The same is true about mounting either opening 165, 166 with lower pin 145 (or 147). In each case, the remainder of the member 160 extends through opening 154 or 142 (or 143**).

Figure 22:
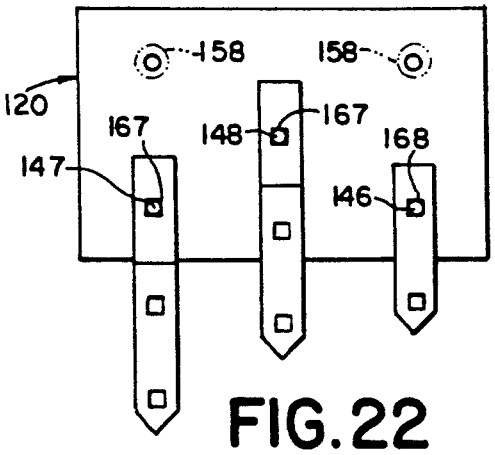

To mount center opening 167 with center pin 148, the top segment **160*a* is preferably removed, as depicted in the center of FIG. 22, unless a central opening is provided through the upper narrow side 126 of signboard 120, in which case the member 160 can be extended through that opening. The bottom segment 160*c* of member 160 is not sufficiently long to extend downwardly from center pin 148 through bottom side 127** and, therefore, would not be used.

The mountings shown in FIG. 20 permit sign 120 to be supported from above on a horizontal member engaged by hook-shaped projections 161, 162 or by means of hooks or other elements passed through any of the exposed openings 165–168. In the configuration shown in FIG. 21, the signboard 120 would be preferably supported from behind the board, again by the hook-shaped projections 161, 162, or from beneath the board 120 on the exposed lower ends of members 160. In the configurations shown in FIG. 22, the signboard 120 would preferably be supported by the pointed end 171 of member(s) 160 protruding from beneath the sign through lower openings 142, 143, 154. These ends can be inserted into a mass of soft material, or slipped between adjoining objects.

Figure 25:
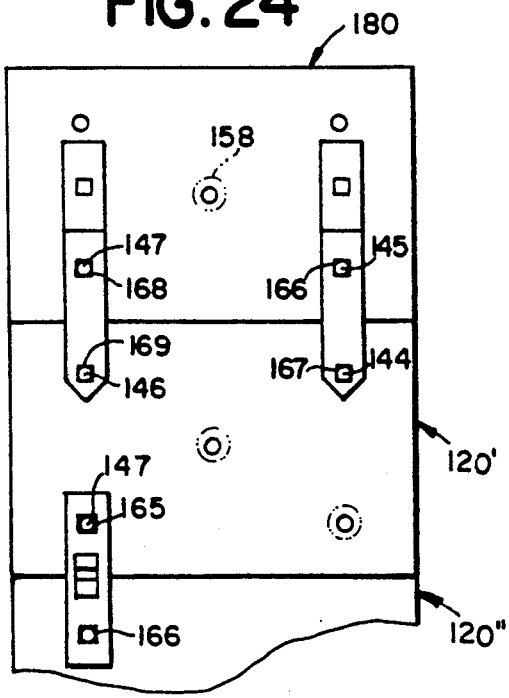
FIG. 25 depicts diagrammatically several of the different possible configurations for mounting pairs of the signboards of the present invention in coplanar relation using portions of the first modular support members.

FIG. 25 shows three of four possible combinations of holes 165–169 of support members 160 used to couple together the protruding pin mating means 144–148 of various signboards in coplanar orientation of the major sides of the signboards 120, 120' and 120''. The boards are positioned with the narrow sides face-to-face, their openings aligned and their respective first and second axes at least generally coincident. Not depicted but also possible is the junction of adjoining pins 145/144 or 147/146 with openings 167, 168.

FIGS. 23 and 24 depict alternate mountings of preferred embodiment signboards 120 along the bottom narrow side of the disclosed signboard 120. The mounting of FIG. 23 is the same two-point mounting also indicated in FIG. 13. FIG. 24 shows a single point mounting to the bottom wall 127 of the signboard 120 by means of slot 182. Mountings mirroring those of FIGS. 23 and 24, in which the support member segment(s) 181 extend through the upper narrow side 126 of the signboard 120, are possible if the openings mirroring openings 154–156 are provided through the upper narrow side 126 of each signboard.

In addition, in those configurations such as FIGS. 20 and 22–24, where the upper segment 160*a* of a support member 160 is not provided within or spanning one of the edges of the signboard 120, the coupling means tube lengths 158 can be provided for joining signboards back-to-back. Some of the various possible tube lengths 158 are indicated in phantom in those figures on illustrated pins. Not depicted in any of FIGS. 13–23 but also possible is the mating of bar member pins extending through openings 136 and/or 137 through the tube lengths 158. It is further expressly noted that the figures are entirely diagrammatic and that one should not rely upon the invention being limited to just the relative proportions shown in the various figures.

Although preferred and other embodiments have been disclosed and suggested, it will be recognized by those skilled in the art that changes may be made to the invention, as described above, without departing from the board, inventive concepts thereof. Accordingly, the scope of the invention is indicated by the following claims rather than the foregoing specification.

I claim:

1. A multifunctional mechanical display system comprising:

a first signboard having a pair of opposing major sides and at least one pair of generally parallel narrow sides on opposing ends of the signboard, one major side defining a substantially planar display area, and each narrow side extending between the pair of major sides;

mounting means for removably mounting at least a first bar member to the signboard in the display area extending at least generally parallel to longitudinal directions of the pair of narrow sides;

at least one of the pair of narrow sides having at least a first opening therethrough;

at least one mating means on a remaining one of the pair of major sides of the signboard, the one mating means being at least generally centered along a first axis extending through the first opening, the first axis being at least generally parallel to the plane of the display area and generally perpendicular to the longitudinal direction of the one narrow side;

a second opening through the one narrow side, the first and second openings being spaced from one another and located proximal longitudinal ends of the one narrow side;

a second mating means on the remaining one of the major sides of the signboard generally centered along a second axis through the second opening, the second axis being laterally spaced from and generally parallel to the first axis; and two openings through a remaining one of the narrow sides of the one pair, one of the two openings being centered with respect to the first axis and a remaining one of the two openings being centered generally with respect to the second axis.

2. The display system of claim 1 wherein the mating means comprises a pin projecting from the remaining major side.

3. The display system of claim 1 further comprising a support member coupled with the one mating means on the remaining one of the pair of major sides and adapted for supporting the signboard with the planar display area generally vertically oriented.

4. The display system of claim 3 wherein the support member is generally planar and includes a pair of adjoining projections, the projections having a space therebetween and extending generally perpendicularly to the plane of the display area.

5. The display system of claim 3 wherein the support member protrudes through the second opening in the one narrow side of the first pair and terminates in a generally pointed end.

6. The display system of claim 3 wherein the support member is modular, a first portion of the support means projecting through the second opening in the remaining one of the first pair of narrow sides and mating with a second supporting member at least substantially identical to the first portion of the support member and oriented perpendicularly to the projecting first portion.

7. The display system of claim 3 wherein the support member protrudes through the first opening in the one narrow side and includes a projection configured to engage a horizontally oriented cylindrical support.

8. The display system of claim 3 wherein the support member protrudes through the first opening in the one narrow side and is releasably engaged with a mating element of a second signboard supporting the first signboard.

9. The display system of claim 1 further comprising:

a third signboard substantially identical to the first signboard with a first major side having a central display area and a remaining major side, the remaining major side of each of the first and third signboards having at least first and second mating means; and means for coupling together at least one mating means of the first signboard and one mating means of the second signboard with the remaining major sides of the first and third signboards facing one another.

10. A multifunctional mechanical display system comprising;

a first signboard having a pair of opposing major sides and at least one pair of generally parallel narrow sides on opposing ends of the signboard, one major side defining a substantially planar display area and each narrow side extending between the pair of opposing major sides, at least one mating means on a remaining one of the pair of major sides for mating with a second element of the system;

mounting means for removably mounting at least a first bar member to the first signboard in the display area extending at least generally parallel to longitudinal directions of the pair of narrow sides;

a second signboard having a pair of opposing major sides and at least one pair of parallel narrow sides on opposing ends of the signboard, one of the pair of major sides defining a substantially planar display area and each of the pair of narrow sides extending between the pair of opposing major sides, at least one mating means on a remaining one of the major sides for coupling the second signboard with the first signboard; and coupling means coupling together at least one of the mating means of the first signboard with one of the mating means of the second signboard with the display areas of the first and second signboards at least generally parallel and the remaining major sides of the first and second signboards in face-to-face orientation.

11. The system of claim 10 wherein the coupling means protrudes through at least one of the narrow sides of at least one of the first and second signboards.

12. A multifunctional mechanical display system comprising:

a first signboard having a pair of opposing major sides and at least one pair of generally parallel narrow sides on opposing ends of the signboard, one major side defining a substantially planar display area, and each narrow side extending between the pair of major sides;

mounting means for removably mounting at least a first bar member to the signboard in the display area extending at least generally parallel to longitudinal directions of the pair of narrow sides;

at least one of the pair of narrow sides having at least a first opening therethrough;

at least one mating means on a remaining one of the pair of major sides of the signboard, the one mating means being at least generally centered along a first axis extending through the first opening, the first axis being at least generally parallel to the plane of the display area and generally perpendicularly to the longitudinal direction of the one narrow side;

a second signboard substantially identical to the first signboard; and means for joining the remaining major sides of the signboards together in face-to-face orientation by coupling together facing mating means of the signboards.

13. The display system of claim 12 further comprising a support member extending through at least one opening in one of the narrow sides of one of the first and second signboards, the support member being configured to support the coupled together first and second signboards with the display areas at least generally vertically oriented.

14. The display system of claim 13 wherein the support member protrudes through the second opening in the one narrow side and terminates in a generally pointed end.

15. The display system of claim 13 wherein the support member is generally planar and includes a pair of adjoining projections, the projections having a space therebetween and extending generally perpendicularly to the plane of the display area.

16. The display system of claim 13 wherein the support member protrudes through the first opening in the one narrow side and includes a projection configured to engage a horizontally oriented cylindrical support.

17. The display system of claim 13 wherein the support member protrudes through the first opening in the one narrow side and is releasably engaged with a mating element of a third signboard supporting the first and second signboards.

18. A multifunctional mechanical display system comprising:

a first signboard having a pair of opposing major sides and at least one pair of generally parallel narrow sides on opposing ends of the signboard, one major side defining a substantially planar display area, and each narrow side extending between the pair of major sides;

mounting means for removably mounting at least a first bar member to the signboard in the display area extending at least generally parallel to longitudinal directions of the pair of narrow sides;

at least one of the pair of narrow sides having at least a first opening therethrough;

at least one mating means on a remaining one of the pair of major sides of the signboard, the one mating means being at least generally centered along a first axis extending through the first opening, the first axis being at least generally parallel to the plane of the display area and generally perpendicular to the longitudinal direction of the one narrow side;

a second signboard having a pair a opposing major sides, one major side including a central substantially planar display area, and at least one pair of parallel, narrow sides extending generally perpendicularly to the plane of the display area at opposing ends of the one major side, at least one opening through one of the pair of narrow sides, and a mating means on a remaining major side of the second signboard, the second signboard being coplanar with the first signboard with the openings through the narrow sides of the signboards adjoining and aligned; and means for coupling together the one mating means of the first signboard with the mating means of the second signboard through the aligned openings.

19. The display system of claim 18 wherein the one major side of the first signboard differs in size from the one major side of the second signboard.

20. The system of claim 18 wherein the coupling means couples together the first and second signboards in a coplanar orientation in which only one of the narrow sides of the first signboard adjoins only one of the narrow sides of the second signboard.

* * * * *